US011266901B2

(12) United States Patent
Paris

(10) Patent No.: US 11,266,901 B2
(45) Date of Patent: Mar. 8, 2022

(54) MOTORIZED SKATEBOARD WITH PRESSURE-ACTIVATED DIRECT REVERSE STEERING

(71) Applicant: MGA Entertainment, Inc., Winnetka, CA (US)

(72) Inventor: Jeffrey Paris, Los Angeles, CA (US)

(73) Assignee: MGA Entertainment, Inc., Chatsworth (CA)

( * ) Notice: Subject to any disclaimer, the term of this patent is extended or adjusted under 35 U.S.C. 154(b) by 0 days.

(21) Appl. No.: 16/594,579

(22) Filed: Oct. 7, 2019

(65) Prior Publication Data

US 2020/0122017 A1 Apr. 23, 2020

Related U.S. Application Data

(60) Provisional application No. 62/748,199, filed on Oct. 19, 2018.

(51) Int. Cl.
*A63C 17/12* (2006.01)
*A63C 17/01* (2006.01)

(52) U.S. Cl.
CPC ..... *A63C 17/12* (2013.01); *A63C 17/012* (2013.01); *A63C 17/013* (2013.01); *A63C 17/015* (2013.01)

(58) Field of Classification Search
CPC ..... A63C 17/12; A63C 17/012
See application file for complete search history.

(56) References Cited

U.S. PATENT DOCUMENTS 3,069,182 A 12/1962 Hufford
3,771,811 A * 11/1973 Bueno ..... A63C 17/013 280/87.042
4,155,565 A * 5/1979 de Caussin ..... A63C 17/0046 280/11.19
4,160,554 A * 7/1979 Cooney ..... A63C 17/01 280/87.042
4,202,559 A * 5/1980 Piazza, Jr. ..... A63C 17/013 280/11.27

(Continued)

OTHER PUBLICATIONS

"Be Boards" on Kickstarter at https://www.kickstarter.com/projects/921997810/be-bordz?ref=discovery&term=skateboards, retrieved Oct. 19, 2018.

(Continued)

*Primary Examiner* — James A Shriver, II
*Assistant Examiner* — Michael T. Walsh
(74) *Attorney, Agent, or Firm* — Hansen IP Law PLLC

(57) ABSTRACT

A motorized skateboard has a maneuverable rear truck. The riding platform on which the user stands includes a rotatable steering platform that the rider can step on with his rear foot. In the nominal position the steering platform extends slightly above the rest of the riding platform and is locked from rotating. When a user steps on the steering platform, the steering platform gets pushed downward against a spring. The downward movement causes a wedge to force apart two pawl level arms, thus disengaging respective pawls from a ratchet thereby unlocking the steering. In this position the steering platform is rotationally coupled to the rear truck through two spur gears acting in serial such that as the user pivots his foot clockwise, the rear truck turns counterclockwise, and vice versa. The result is a steering motion that is similar to turning a snowboard.

20 Claims, 14 Drawing Sheets

(56) References Cited

U.S. PATENT DOCUMENTS

| | | | | |
|---|---|---|---|---|
| 4,274,647 | A | 6/1981 | Drake, Jr. | |
| 4,930,794 | A | 6/1990 | Chan | |
| 4,955,626 | A | 9/1990 | Smith et al. | |
| 5,029,887 | A | 7/1991 | Grützner et al. | |
| 5,052,702 | A | 10/1991 | Chan | |
| 5,236,208 | A * | 8/1993 | Welsh | A63C 17/013 280/11.27 |
| D357,523 | S | 4/1995 | Givens | |
| D397,753 | S | 9/1998 | Lin | |
| 5,860,657 | A * | 1/1999 | Kroher | A63C 17/0033 280/11.223 |
| D437,377 | S | 2/2001 | Fisher | |
| 6,419,248 | B1 * | 7/2002 | Kay | A63C 17/01 280/87.01 |
| 8,226,095 | B2 | 6/2012 | Reyes, Jr. | |
| 8,925,936 | B1 | 1/2015 | Clos et al. | |
| 9,393,483 | B2 | 7/2016 | Tan | |
| 9,987,546 | B1 | 6/2018 | Clos et al. | |
| 2002/0108796 | A1 * | 8/2002 | Baker | A63H 11/10 180/181 |
| 2009/0038430 | A1 * | 2/2009 | Itazu | F16H 63/3458 74/503 |
| 2012/0264579 | A1 * | 10/2012 | Klein | A63B 22/0015 482/146 |
| 2012/0326408 | A1 * | 12/2012 | Bellon | B62B 17/08 280/87.041 |
| 2013/0206493 | A1 * | 8/2013 | Larson | A63C 17/012 180/181 |
| 2015/0238845 | A1 * | 8/2015 | Clayton | A63C 17/015 280/87.042 |
| 2016/0107070 | A1 * | 4/2016 | Middleton | A63C 17/012 280/87.042 |
| 2018/0043236 | A1 * | 2/2018 | Baldauf | A63C 17/013 |
| 2018/0162478 | A1 * | 6/2018 | Silverwood | B60B 19/003 |
| 2021/0268363 | A1 * | 9/2021 | Carr | A63C 5/06 |

OTHER PUBLICATIONS

"The Double Lazy Susan Skateboard" on Youtube at https://www.youtube.com/watch?v=p0Tz9hIXIAE, screen shots captured Oct. 19, 2018.

* cited by examiner

MOTORIZED SKATEBOARD WITH PRESSURE-ACTIVATED DIRECT REVERSE STEERING

CROSS-REFERENCE TO RELATED APPLICATIONS

This application claims the benefit of U.S. Provisional Patent Application Ser. No. 62/748,199 filed Oct. 19, 2018, which is hereby incorporated by reference as if set forth fully herein.

BACKGROUND OF THE INVENTION

1. Field of the Invention

This invention relates to the field of skateboards and motorized skateboards. More particularly, this invention relates to the field of a motorized skateboard having pressure-activated direct reverse steering.

2. Description of Related Art

Skateboards and motorized skateboards have long been known. A typical skateboard includes a front truck and a rear truck, each truck carrying one wheel on either end of an axle. Standard skateboard trucks are mechanisms by which a user can shift his weight to one side or the other to cause the axles to turn, thereby turning the skateboard. This can be considered to be a type of indirect steering. Skateboards have also been proposed that have direct steering of the front and/or rear axles.

U.S. Pat. No. 3,771,811 to Bueno discloses a child's coaster having a round steering platform at the rear of the riding platform coupled to the rear axle such that a user can directly turn the rear axle using his foot.

U.S. Pat. No. 4,202,559 to Piazza, Jr. purports to disclose a skateboard having a round steering platform on the top face of the riding platform toward the front of the platform, and a linkage system connecting the steering platform to the front wheel assembly, so that the rider can pivot his front foot on the steering platform and thus directly turn the front wheel assembly. The linkage also has a return spring that biases the wheel assembly to the front-facing position.

U.S. Pat. No. 5,236,208 to Welsh discloses a platform-steerable skateboard having user-steering platforms at both the front and rear of the rider platform so that a user can directly turn the front and rear axles by pivoting his front foot and rear foot, respectively.

U.S. Pat. No. 8,925,936 to Clos. et al. discloses a skateboard having front and rear circular pads on the top of the skateboard platform on which a user can stand with his two feet, respectively, with each pad being directly coupled to the respective truck axle beneath the platform, such that as the user rotates his front foot the front axle rotates in the same direction and to the same extent as his front foot, and as the user rotates his rear foot the rear axle rotates in the same direction and to the same extent as his rear foot.

U.S. Pat. No. 9,987,546 to Clos et al. discloses similar features as described in the above paragraph, as well as a north-seeking return mechanism that biases the axles back to their nominal positions in which the skateboard moves forward in a straight line.

U.S. Patent Publication 2015/0238845 A1 by Clayton discloses a freestyle board having front and rear rotatable footplates such that a user can pivot his front and rear feet thereby turning the front and rear axles directly. An alignment mechanism automatically returns the footplate assembly and wheels back to the neutral position when no turning force is applied. A locking mechanism either allows or prevents the footplate assembly from rotating.

SUMMARY OF THE INVENTION

The inventors have discovered that a skateboard having a maneuverable truck is more intuitive and/or enjoyable to ride to at least some riders, particularly experienced skateboarders and snowboarders, if the truck turns in the reverse direction as the control foot, rather than in the same direction as in the prior art listed above. In such a skateboard, the reverse steering more naturally simulates the feeling of snowboarding in which a rider twists his rear foot to the right to make the rear of the snowboard drift to the left and hence the board turn to the right. It produces in the rider a feeling similar to "drifting," i.e., the rear of the board drifting or sliding out. Thus, the skateboard of the present invention could be referred to as a "drift board," having a different riding feel than a regular skateboard. In a drift board, or drift type steering, in order to steer to the right the user drifts the rear of the board to the left, and vice versa.

Accordingly, one aspect of the present invention is a skateboard that has a steering platform or steering disc that is connected through gearing to a truck below such that as the user turns or pivots his front foot located on the steering platform in the clockwise (CW) direction, the truck and wheels turn in the counterclockwise (CCW) direction. Similarly, when the user pivots his foot located on the steering platform in the CCW direction, the truck and wheels turn in the CW direction. The steerable truck may be either the front truck or the rear truck. In the exemplary embodiment, the rear truck is the steerable truck.

In another aspect, the steering platform is spring biased to an upward position in which the steering platform is rotationally locked, such that the steering platform becomes unlocked and therefore can rotate only after a user has first placed his foot down on the steering platform with the pressure of the user's weight, moving the platform downward slightly thus unlocking the steering mechanism. This feature provides greater predictability in handling, assuring the rider that the trucks will act as normal skateboard trucks without any additional rotation as long as the rider's rear foot is not on, or is otherwise not pressing down on, the steering platform. Without such a steering lock the board has a tendency to turn in the wrong direction when the user attempts to lean to turn the board as with a conventional skateboard: The board has a tendency to turn right when the user leans left, and vice versa. This could make the board more difficult and dangerous to ride, and/or have a higher learning curve.

More particularly, in the illustrative embodiment the steering platform lock mechanism includes a wedge coupled to the underside of the steering platform that is pressed downward when the user steps on the steering platform. The wedge moving downward forces a pair of pawls outward. The pawls moving outward disengages the pawls from stops or recesses in a first spur gear which is rotationally coupled to the steering platform, freeing the first spur gear to rotate. The first spur gear meshes with and turns a second spur gear that is attached to the rear truck, with the two spur gears being arranged in serial to turn in opposite directions. Thus, when a user steps on the steering platform, the two spur gears are now free to rotate. When the user pivots his foot CW, the first spur gear also turns CW, and the second spur gear and the truck turn CCW. Because the truck steering can be unlocked and locked by the user stepping with his rear foot from the riding platform to the steering platform simply by changing his foot position, the user can selectively lock and unlock the steering mechanism while is riding the board. The user steps on the steering platform with his rear foot to unlock the steering mechanism, and removes his rear foot from the steering platform in order to lock the steering mechanism again. With the steering mechanism locked once again, the board once more acts as a normal skateboard having conventional front and rear trucks.

The steering mechanism has at a return-to-center bias spring(s) that, in the absence of a rider turning the steering platform, returns the steering to straight-ahead steering or center steering. When the steering platform is returned to straight-ahead steering without the steering platform being pressed down by the weight of a rider's rear foot, the steering mechanism automatically locks in the straight-ahead position. Thus the rider does not need to align the steering platform back to the centered position before stepping off of it to lock the drift mechanism, nor does the rider need to step off the board and manually move the steering into the straight-ahead position and/or to manually lock the steering in that position. By simply stepping off the steering platform and either steering the board straight ahead or picking up the board, the board is returned to normal skateboard operation and remains in that mode until the user steps on the steering platform again. The feature that the board, when picked up, automatically returns to being locked into its normal skateboard mode, enhances safety because otherwise a rider might forget that the board is in the rider-steering mode and might later place the board down onto the ground and step on to ride it, forgetting that the board is in the rider-steering mode which could lead to an accident. With the board as disclosed herein, however, a rider will quickly learn and remember that, unless and until he steps on the steering platform, the board will always be in the normal skateboard mode.

Additionally, a rotation limiter selectively and variably limits the maximum steering rotation of the rear axle. This feature helps with the learning curve of using the board. For example, beginners can start with a small maximum drift or turning angle of approximately +12° which corresponds to a relatively large turning radius. More experienced riders can adjust the board for a larger turning angle of approximately +24° which corresponds to a somewhat smaller turning radius, and advanced users can use a maximum turning angle of approximately +36° which corresponds to a tight turning radius. Additionally, a locked position of the steering limiter allows no turning. In that position the user can stand on the steering platform thus taking advantage of the entire available standing area and use the board like a regular longboard with no drifting.

The trucks preferably operate as normal skateboard trucks, so that when the steering mechanism is not being used the skateboard can be steered as normal by the rider leaning to his right or to his left.

The invention can be used on either a motorized skateboard or a non-motorized skateboard. In the preferred embodiment the skateboard is a motorized skateboard, having motorized wheels, a battery, a remote control, and other standard components of motorized skateboards. The remote control can have an ON/OFF switch, a speed control, and optionally a braking control.

Exemplary embodiments of the invention will be further described below with reference to the drawings, in which like numbers refer to like parts. The drawing figures might not be to scale, and certain components may be shown in generalized or schematic form and identified by commercial designations in the interest of clarity and conciseness.

DETAILED DESCRIPTION OF THE PREFERRED EMBODIMENTS

Figure 1:
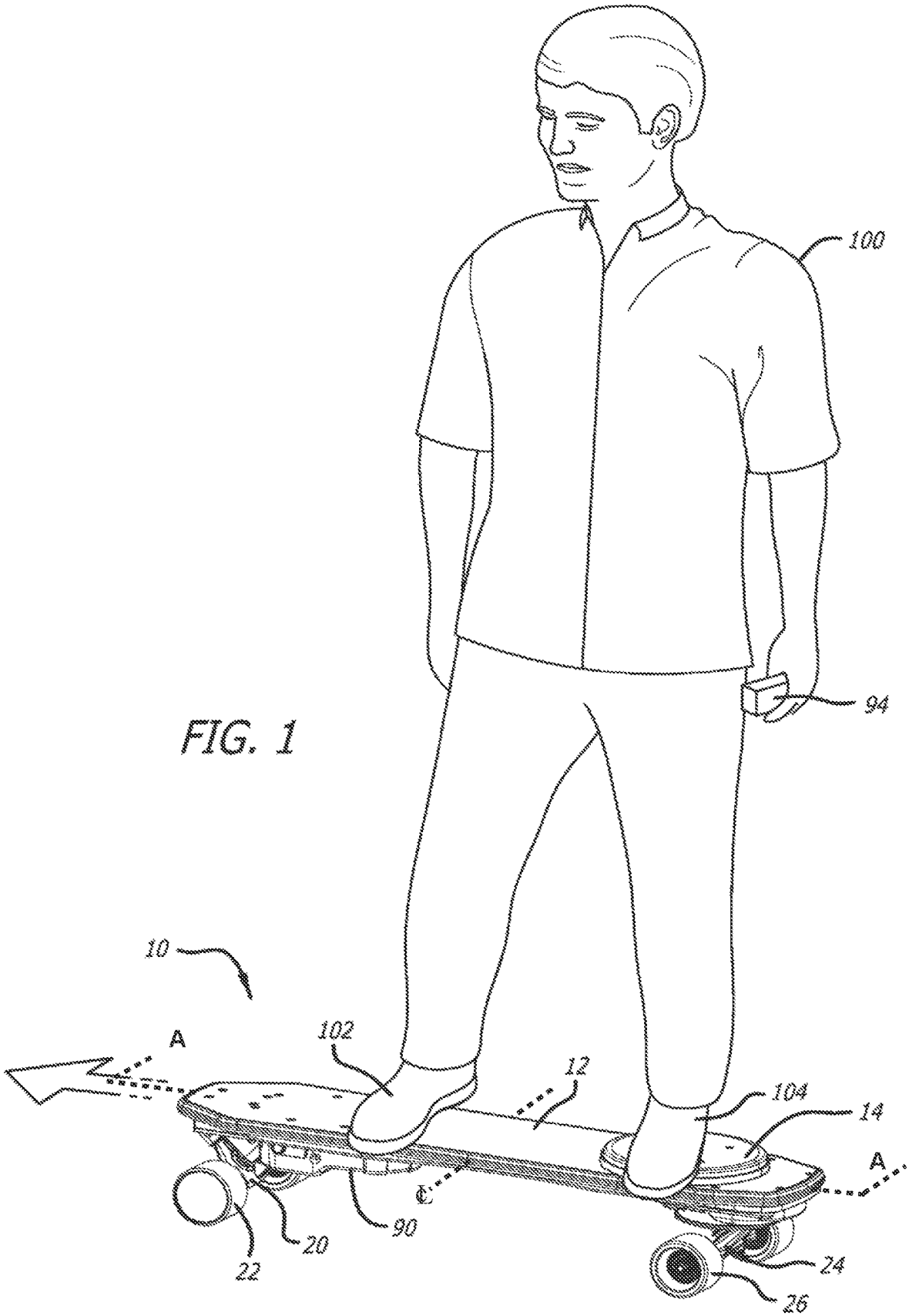
FIG. 1 is a top perspective view of a rider riding a riding board according to a first illustrative embodiment of the invention.

FIG. 1 is top perspective view of a rider 100 riding a riding board 10 according to a first illustrative embodiment of the invention. Riding board 10 includes a front truck 20 including a front wheel axle on which front wheels 22 are mounted, a rear truck 24 including a rear wheel axle on which rear wheels 26 are mounted, and a standing platform or riding platform 12 that is large enough to accommodate both an adult rider's front foot 102 and his rear foot 104. Both the front truck 20 and its associated wheels 22, and the rear truck 24 and its associated wheels 26, are located on an underside of riding platform 12. The rider can selective move his rear foot 104 onto either the riding platform 12 or onto the steering platform or steering disc 14.

The riding board 10 is electrically powered via a battery 90 and one or more motors such as hub motors 92 (FIG. 6) contained inside of wheels 22, the electric motor(s) providing motive force to propel the board 10 forward. The rider is holding a remote control unit 94 which preferably communicates wirelessly such as via radiofrequency signals to the electric motor(s). Remote control unit 94 can include a power ON/OFF switch, a speed control knob or slide, and optionally a braking control that could operate via regenerative braking such as to help recharge the battery when the rider is going downhill. Optionally remote control unit could include controls to selectively lock and unlock the steering of the board.

Via mechanics which will be described below, when the rider is not stepping on steering platform 14 the steering mechanism is locked such that riding board 10 acts as a conventional skateboard having front and rear trucks as is conventional and can be steered as a conventional skateboard via lean-to-turn steering, whether the board's electric drive motor is being utilized or not. When the rider steps down with his rear foot onto steering platform 14, however, the rider enables a steering mechanism that allows the rider to steer the rear truck 24 and hence the rear axle and rear wheels 26 by pivoting his rear foot 104. The steering is thus pressure-activated, and the steering lock is pressure-deactivated. The steering is reverse steering, i.e., when the rider pivots his rear foot 104 clockwise (CW), the rear truck 24 steers in the counterclockwise (CCW) direction and vice versa. Thus the rider directly steers the rear trucks, but in the opposite direction that his foot turns. This type of steering can be termed direct reverse steering. The rear truck 24 is a steerable truck, and the rear axle and rear wheels are the steerable axle and wheels, being steered directly by the rider pivoting his foot.

In order to return operation of the riding board 10 to that of a conventional skateboard, the rider merely steers straight ahead and removes his foot from steering platform 10 whereupon the steering automatically locks into the straight-ahead or neutral steering position via a biased locking mechanism. The board now acts as a conventional skateboard once more, whether electrically powered at the time or not. Alternatively, if the rider dismounts the riding board 10 and picks it up, the return-to-neutral spring(s) 54 (FIG. 4) and the biased locking mechanism automatically return the riding board to conventional skateboard operation. Still further, if the rider takes his foot off the steering platform 14 while riding, springs 15 return the steering platform 14 to the upward position, the return-to-neutral spring(s) 54 tends to return the steering to neutral steering and, once the steering mechanism is in the neutral steering position without a rider pressing down on steering platform 14, the biased locking mechanism will automatically lock the steering into that position. As a conventional skateboard, the front and rear trucks 20, 24 turn by weight shifting as usual, i.e., the skateboard operates with standard lean-to-steer steering, but rear truck 24 does not turn by any action of steering platform 14.

Figure 2:
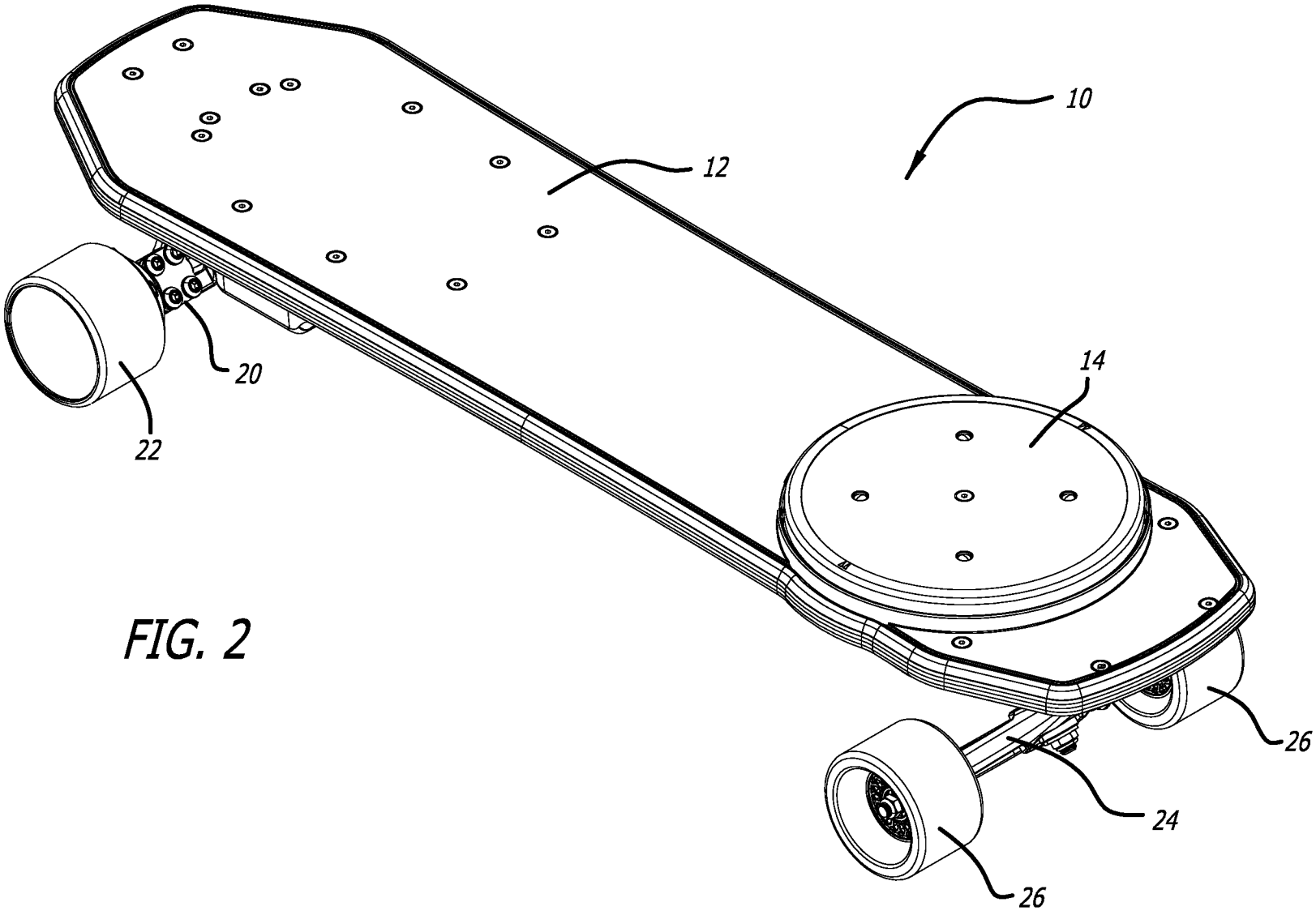
FIG. 2 is a top perspective view of the riding board of FIG. 1.

FIG. 2 is a top perspective view of a the riding board 10 of FIG. 1 without rider 100 present.

Figure 3:
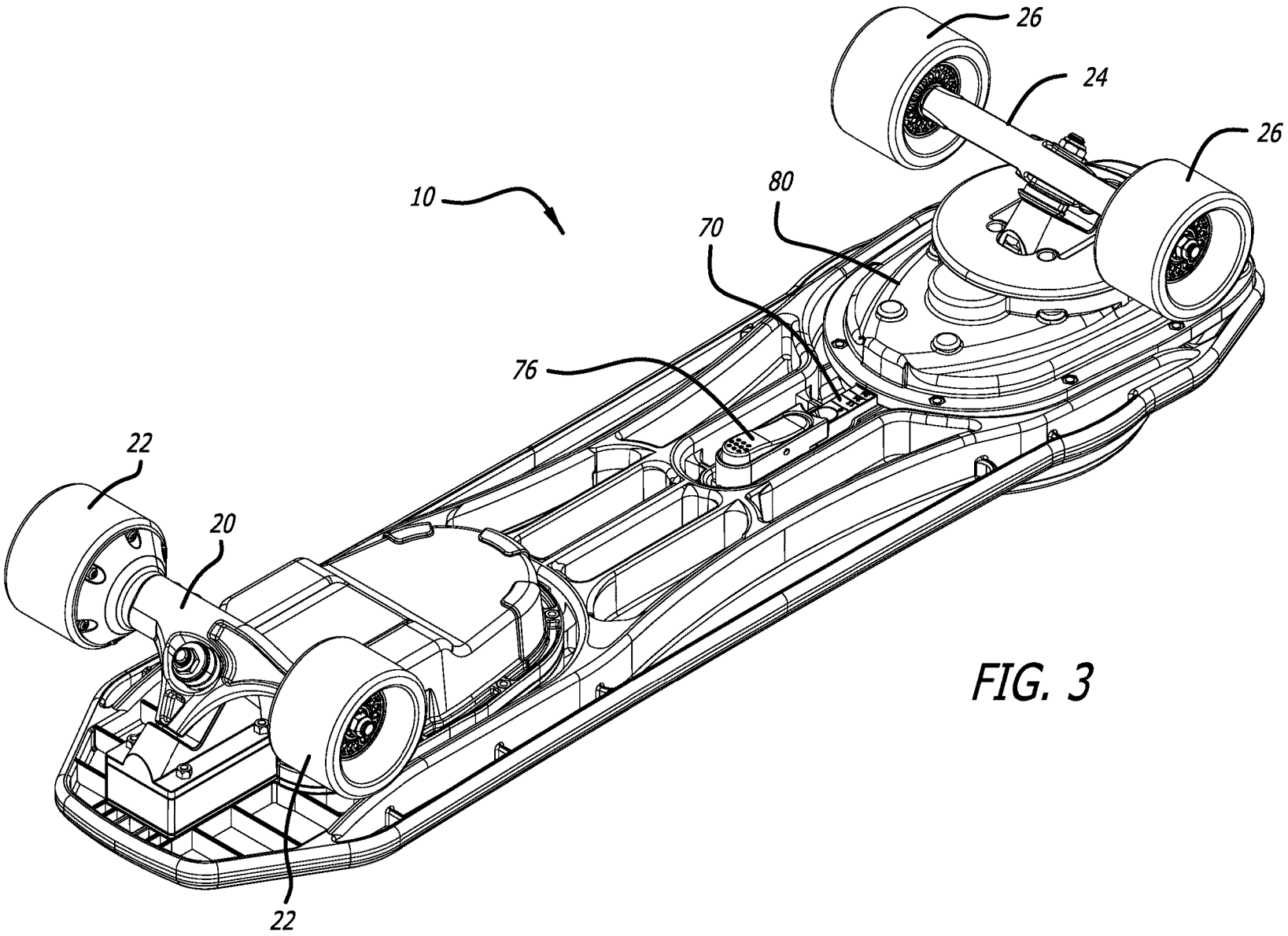
FIG. 3 is a bottom perspective view of the riding board of FIG. 1.

FIG. 3 is a bottom perspective view of the riding board 10 of FIG. 1. A cover 80 covers the steering mechanism. In most of the figures that follow cover 80 is removed to reveal the relevant mechanisms. A user presses slide release lever 76 in order to allow slide lock 70 to move into or out of engagement with the steering mechanism, thus selectively locking the steering mechanism in place which disables steering via steering platform 14, or allowing different amounts of steering freedom for the rider as selected by the rider.

Figure 4:
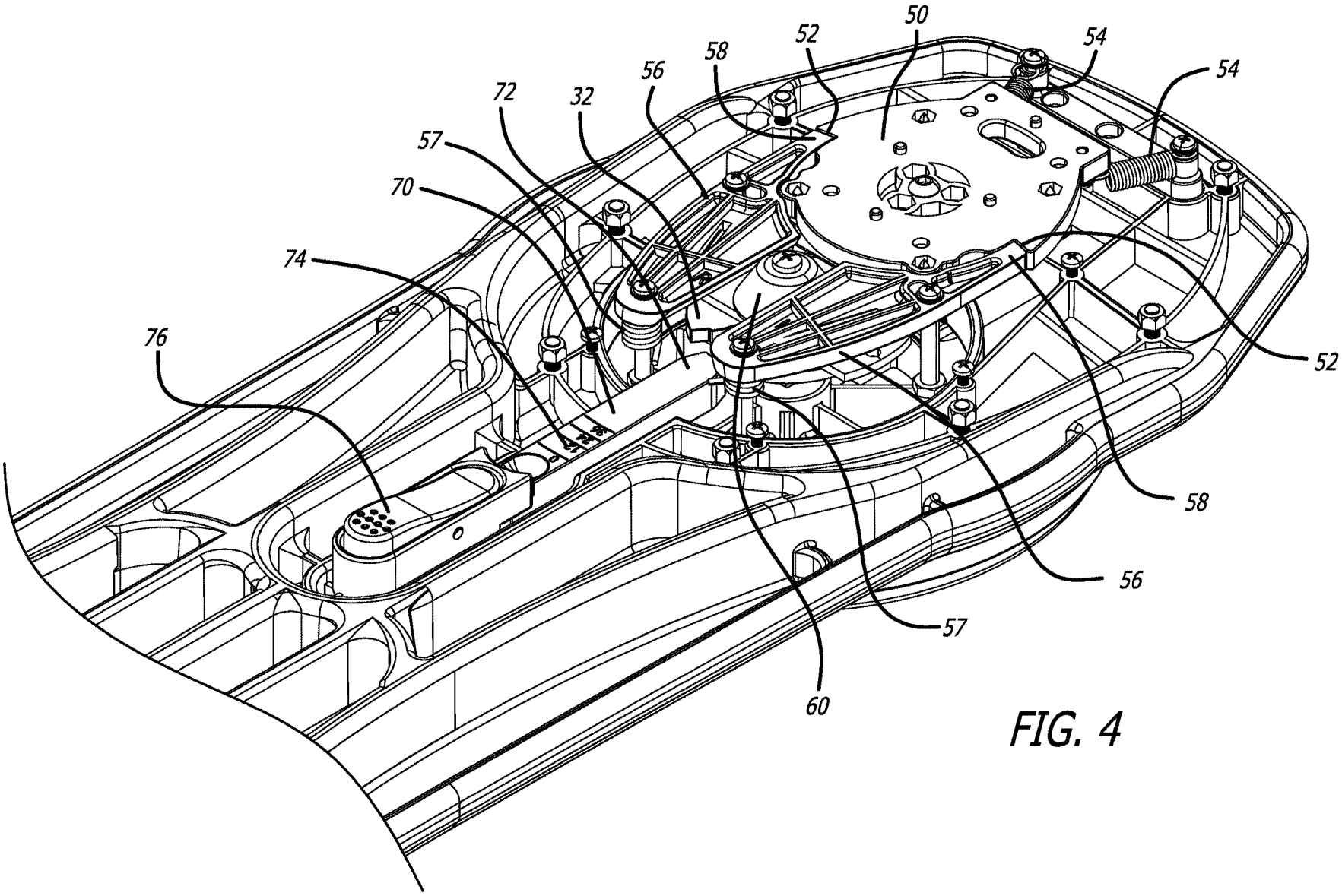
FIG. 4 is a bottom perspective view of the rear portion of riding board of FIG. 1 partially disassembled.

FIG. 4 is a bottom perspective view of the rear portion of the riding board 10 of FIG. 1 partially disassembled. In this view cover 80 and rear truck 24 have been removed for clarity of illustration. Slide lock 70 including tab 72 slides inward toward the right in order lock or partially lock the steering, and slides outward toward the left in order to unlock the steering. A slide release lever 76 allows slide lock 70 to slide. When the user presses down on slide release lever 76, the slide lock 70 slides freely. When the user release slide release lever, a spring (not shown) returns slide release lever 76 to its unpressed position and slide lock 70 cannot slide. Gradations 74 marked on slide lock 70 allow the user to see how much steering freedom will be allowed. In this embodiment the options are 0° (completely locked), ±12°, ±24°, and ±36° degrees of rotational freedom. The rotation lock is shown in greater detail and will be described in greater detail in connection with FIG. 13.

Part of the user-operated steering lock and release mechanism is seen in FIG. 4. Pawls 56 are spring biased by pawl springs 57 toward a more central, or closer together, position as shown. In this position tabs 58 of pawls 56 abut against stops 52 in locking platform 50 which functions as a ratchet, onto which rear truck 24 is mounted, preventing locking platform or ratchet 50 and thus rear truck 24 from rotating. In this position the user cannot turn steering platform 14. Return-to-neutral springs 54 bias the steering mechanism to neutral, i.e., to straight ahead steering with the steering platform 14 in its rotational center position, as shown. A small portion of a first spur gear 32 is visible underneath pawls 56.

Figure 5:
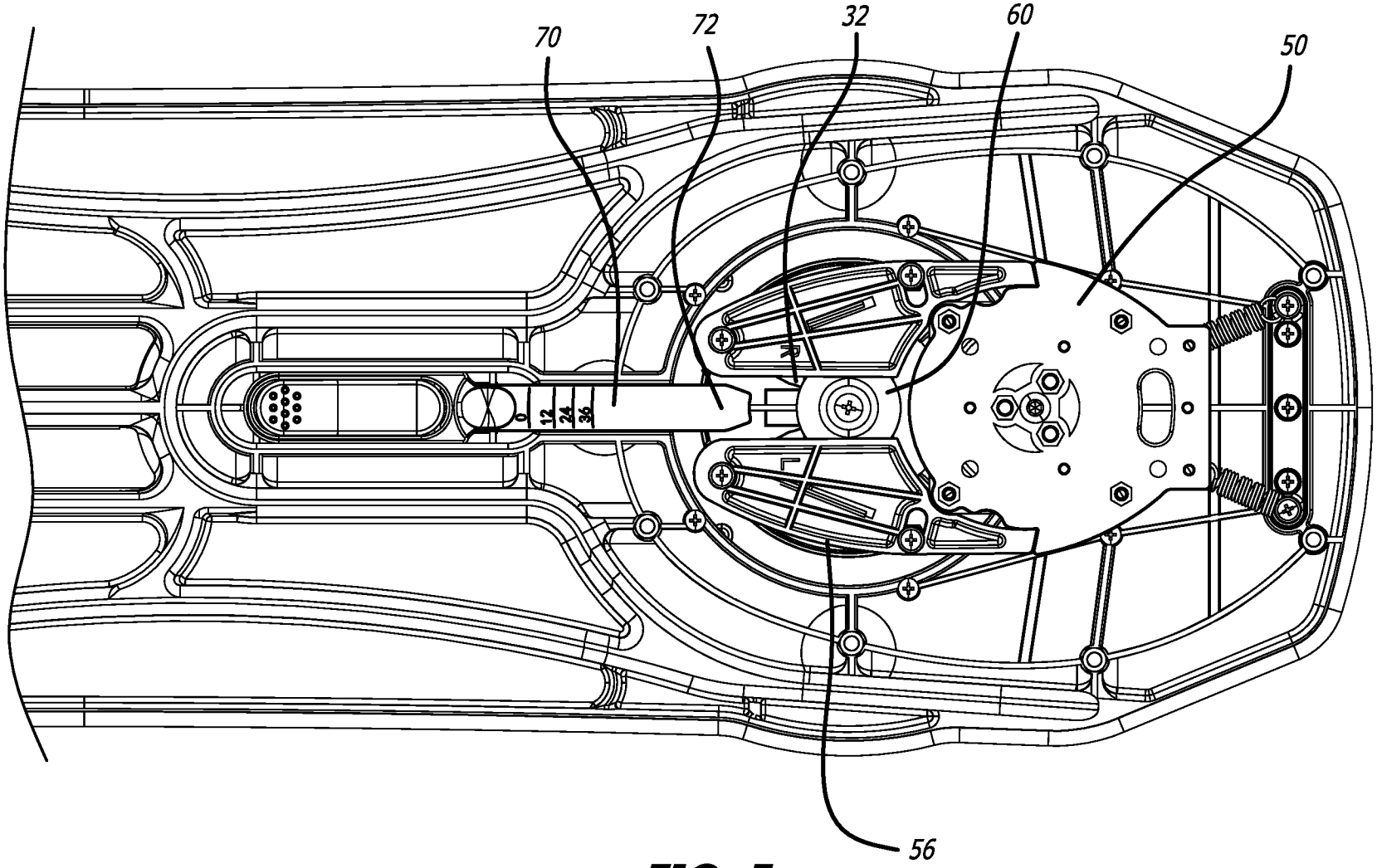
FIG. 5 is a bottom plan view of the partially disassembled riding board of FIG. 4.
Figure 6:
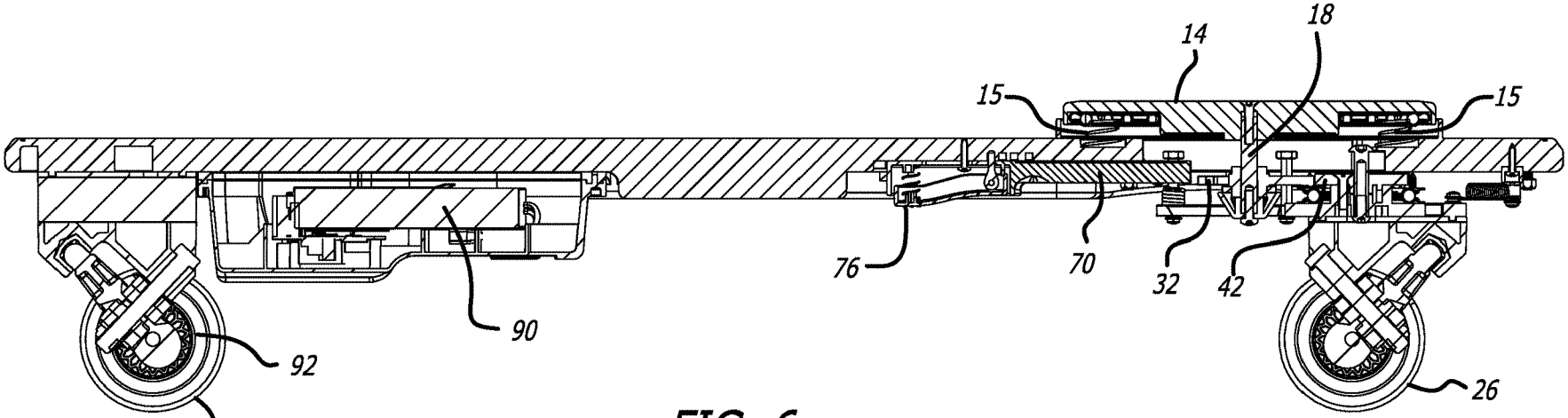
FIG. 6 is a side cross-sectional view of the riding board of FIG. 1 taken along line A-A.

FIG. 5 is a bottom plan view of the partially disassembled riding board of FIG. 4. Slide lock 70 is fully retracted, allowing the maximum degree of steering rotation which is ±36° in this embodiment FIG. 6 is a side sectional view of the riding board of FIG. 1. Hub motor(s) 92 are preferably located inside front wheel(s) 22. Springs 15 constitutes a bias mechanism which biases steering platform 14 into its upward position, which is the position shown. In this position the rider steering mechanism is locked; steering platform 14 cannot rotate. First spur gear 32 and second spur gear 42 are visible beneath the riding platform 12; those gears and their functions will be described in greater detail below.

Figure 7:
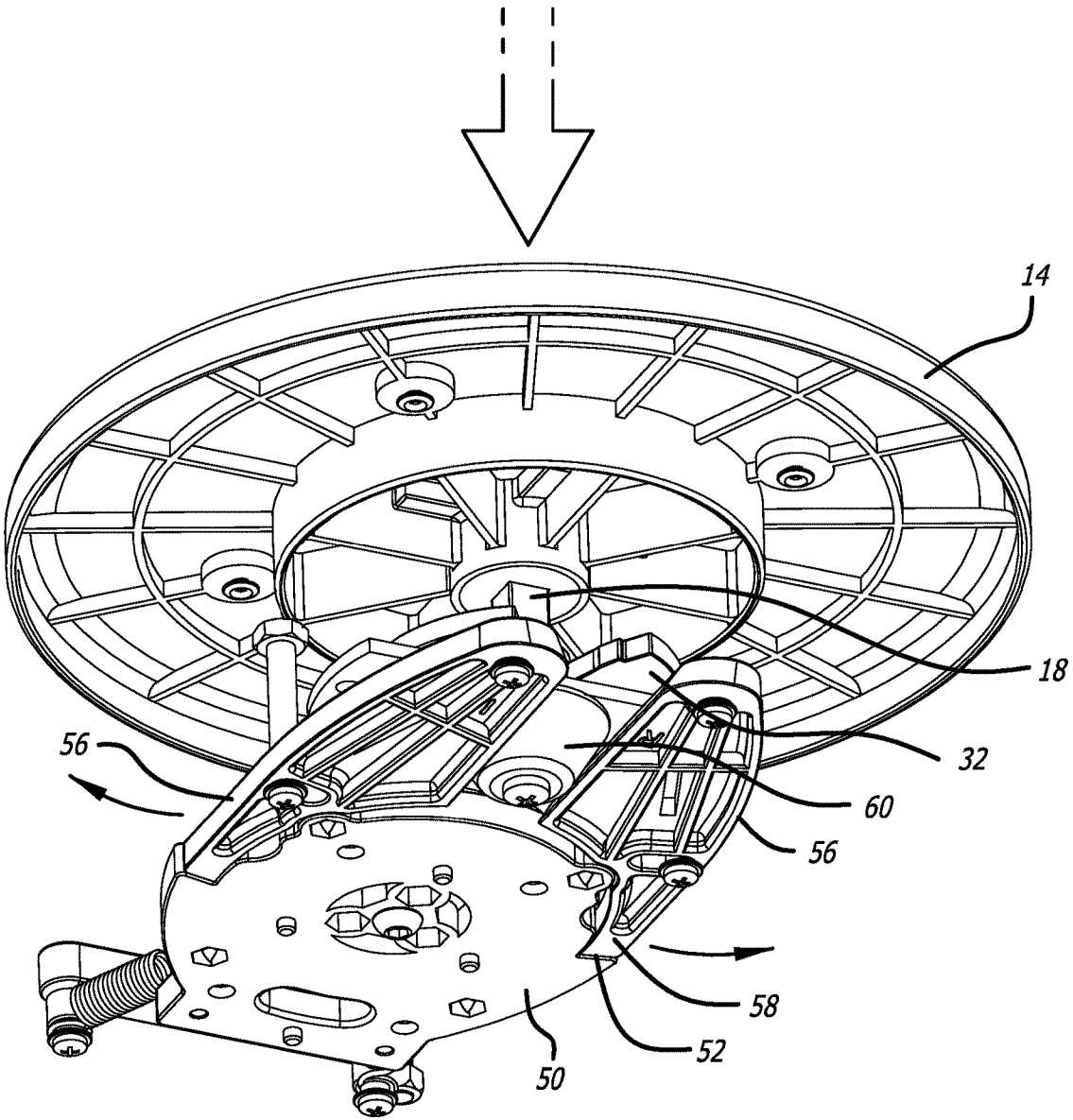
FIG. 7 is a bottom perspective view of just the steering components of the riding board of FIG. 1, with arrows added to illustrate the effect of a rider stepping on the steering platform.

FIG. 7 is a bottom perspective view of just the steering components of the riding board 10 of FIG. 1, with arrows added to illustrate the effect of a rider stepping on steering platform 14. In the position shown in which the steering platform 14 is still in its upward position, pawls 56 are biased against locking platform 50. Tabs 58 on pawls 56 abut against shoulders 52 of locking platform 50, which locks locking platform 50 in place. In this position the entire steering mechanism cannot be turned.

When the user steps on steering platform 14 as illustrated by the arrow, however, that forces steering platform 14 downward against the upward bias force provided by springs 15. Steering platform 14 is coupled to wedge 60 via shaft 18, such that wedge 60 is also moved downward, which in turn forces pawls 56 outward and away from locking platform 50. Once pawls 56 are forced outward and away from locking platform 50, locking platform 50 is free to rotate and thus the rider steering is enabled. In this way, direct rider steering of the rear truck 24 is enabled by the rider stepping on steering platform 14 thereby moving it to its downward position.

Figure 8:
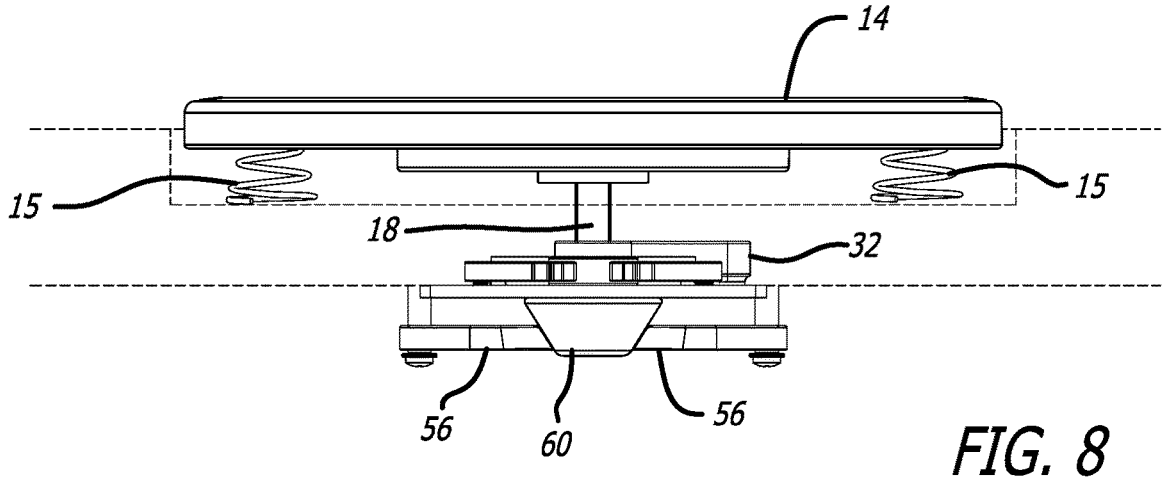
FIG. 8 is a front sectional view of the steering components of FIG. 7 without a rider stepping on the steering platform.

FIG. 8 is a front sectional view of the steering components of FIG. 7 without a rider stepping on steering platform 14. In this position steering platform 14 and wedge 60 are in their upward positions, and pawls 56 are in their inward positions thus preventing locking platform 50 and rear truck 24 from rotating. That is, when the rotatable steering platform 14 is in its upward position, spring-biased pawls 56 and locking platform 50 act as a lock that automatically locks the steering platform 14 into neutral or straight-ahead steering which defines a first rotational position.

Figure 9:
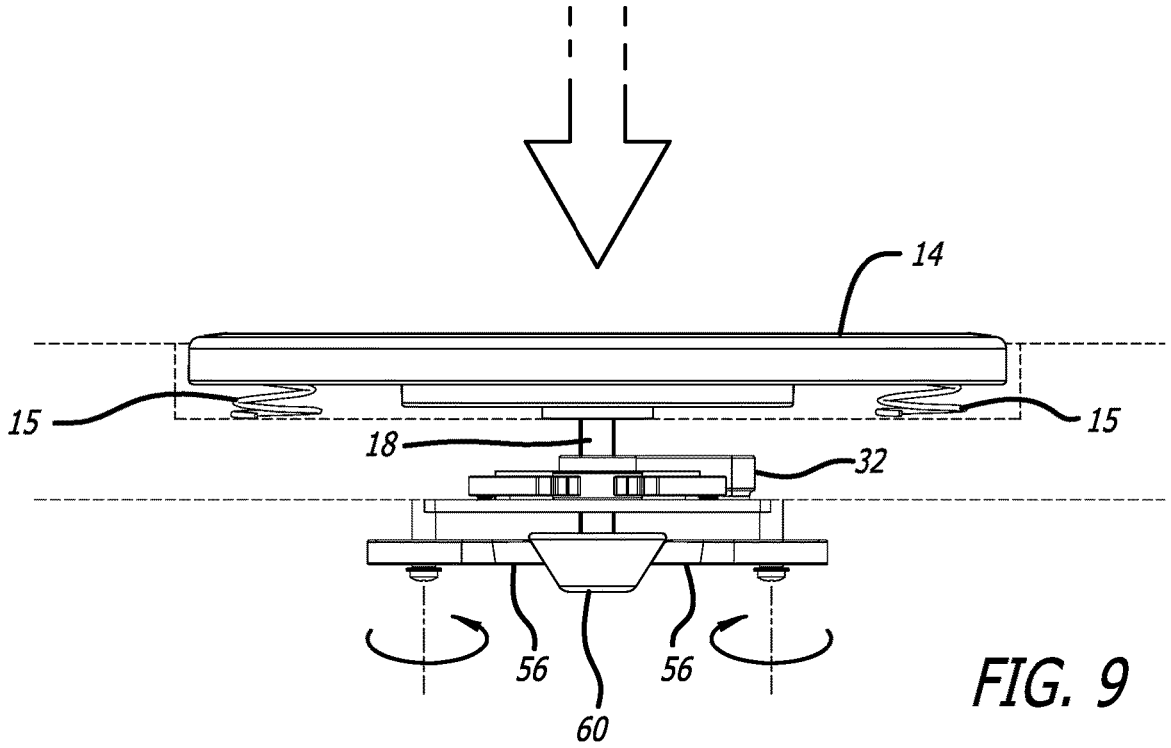
FIG. 9 is a front sectional view of the steering components of FIG. 8 with arrows added to illustrate the effect of a rider having stepped on the steering platform.

FIG. 9 is a front sectional view of the steering components of FIG. 8 with arrows added to illustrate the effect of a rider having stepped on the steering platform. 14. In this position steering platform 14 and wedge 60 are in their downward positions, and pawls 56 have been rotated to their outward positions. In this position pawls 56 do not interfere with rotation of locking platform 50, and hence steering platform 14 is free to rotate. Wedge 60 and pawls 56 act as release mechanism which unlocks and thus enables the steering platform 14 when a rider steps onto that steering platform, thereby allowing the rider to thereafter turn the steering platform 14 and hence steer the rear wheels by pivoting his rear foot.

Shaft 18 has a polygonal cross section such as square or hexagonal and extends through a similarly shaped central hole 35 in first spur gear 32, such that polygonal shaft 18 can move up and down freely through spur gear 32 but any rotation of steering platform 14 and hence of polygonal shaft 18 causes spur gear 32 to rotate. These features are most clearly seen in FIG. 17.

Figure 10:
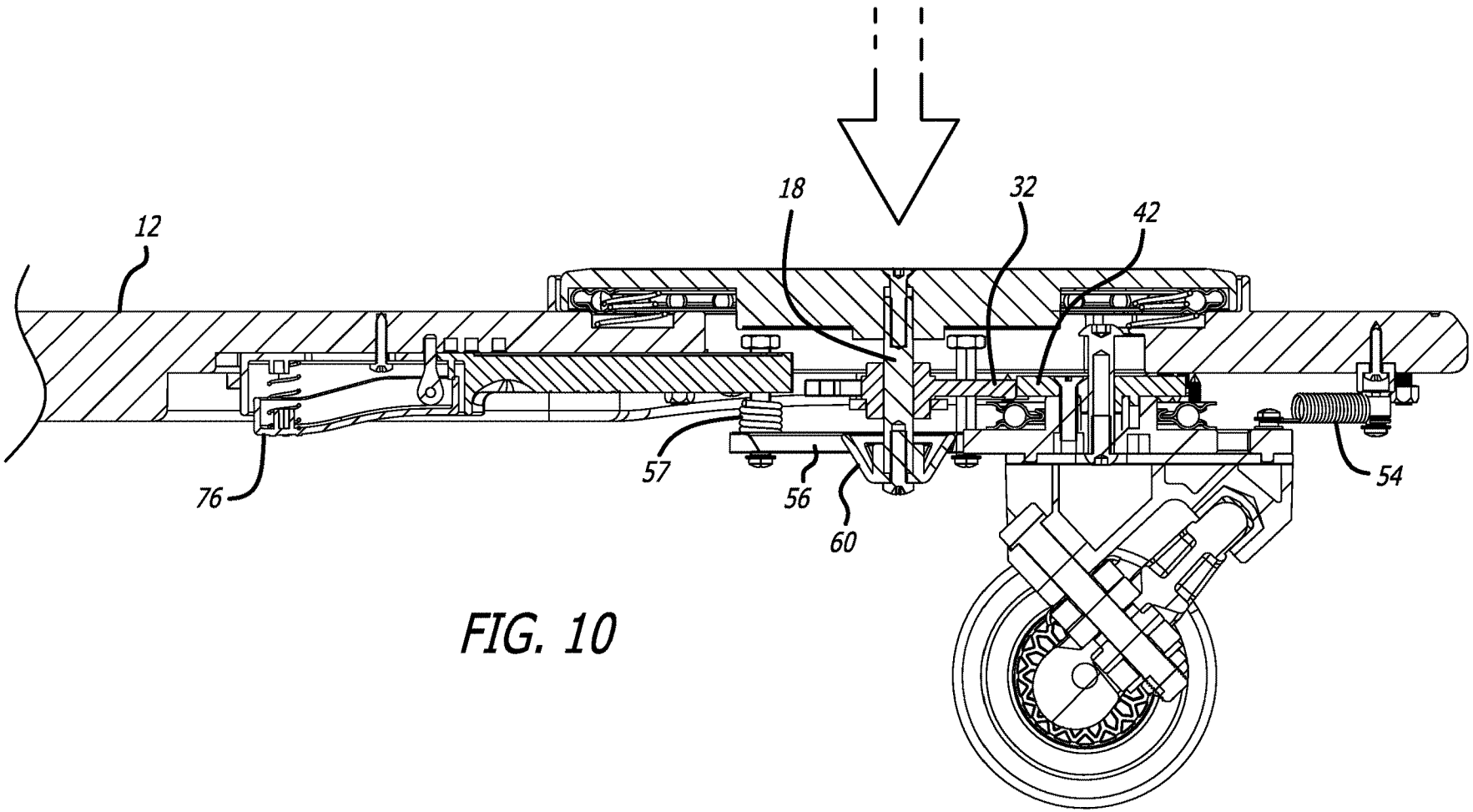
FIG. 10 is a side cross-sectional view taken along line A-A from the centerline to of the rear of the riding board of FIG. 1 with the steering platform in its downward position such that direct reverse steering is enabled.

FIG. 10 is a side sectional view of the rear of the riding board 10 of FIG. 1 with the steering platform 14 in its downward position such that direct rider steering is enabled, which in this case is direct reverse steering.

Figure 11:
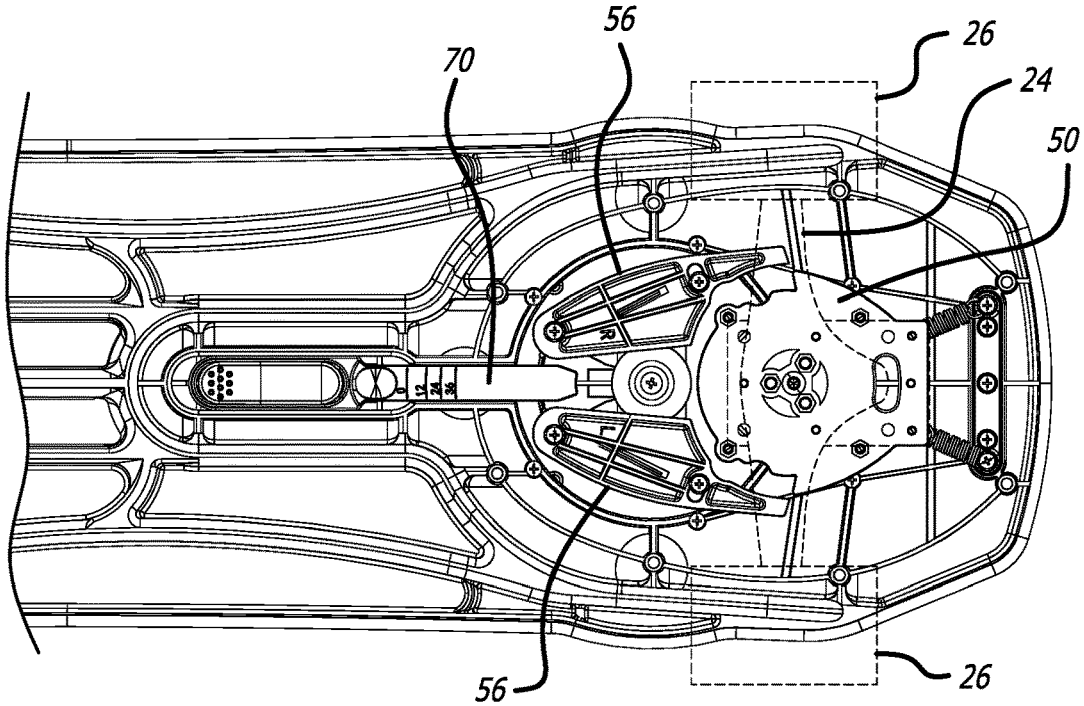
FIG. 11 is a bottom plan view of the partially disassembled riding board of FIG. 4, similar to the view in FIG. 5, but with a rider having stepped on the steering platform and thus enabled steering of the rear truck by the rider.

FIG. 11 is a bottom plan view of the partially disassembled riding board 10 of FIG. 4, similar to the view in FIG. 5, but with a rider having stepped on steering platform 14 thus forcing steering arms 56 away from locking platform 50. Rider steering of the rear truck 24 via steering platform 14 is thus enabled. In this figure the steering is in the neutral position. Rear truck 24 and rear wheels 26 are shown in dashed lines.

Figure 12:
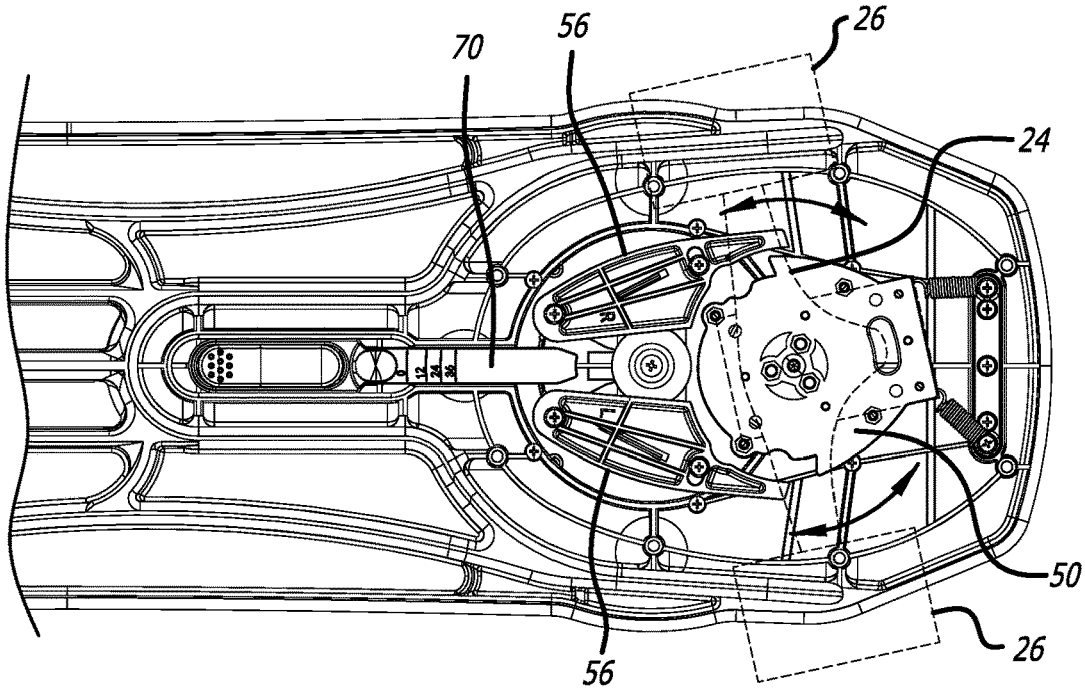
FIG. 12 is a bottom plan view of the partially disassembled riding board of FIG. 11, with the rider now having turned the steering platform and thus the rear truck.

FIG. 12 is a bottom plan view of the partially disassembled riding board 10 of FIG. 11, with the rider now having turned the steering platform 14 and thus the rear truck 24 and rear wheels 26.

Figure 13:
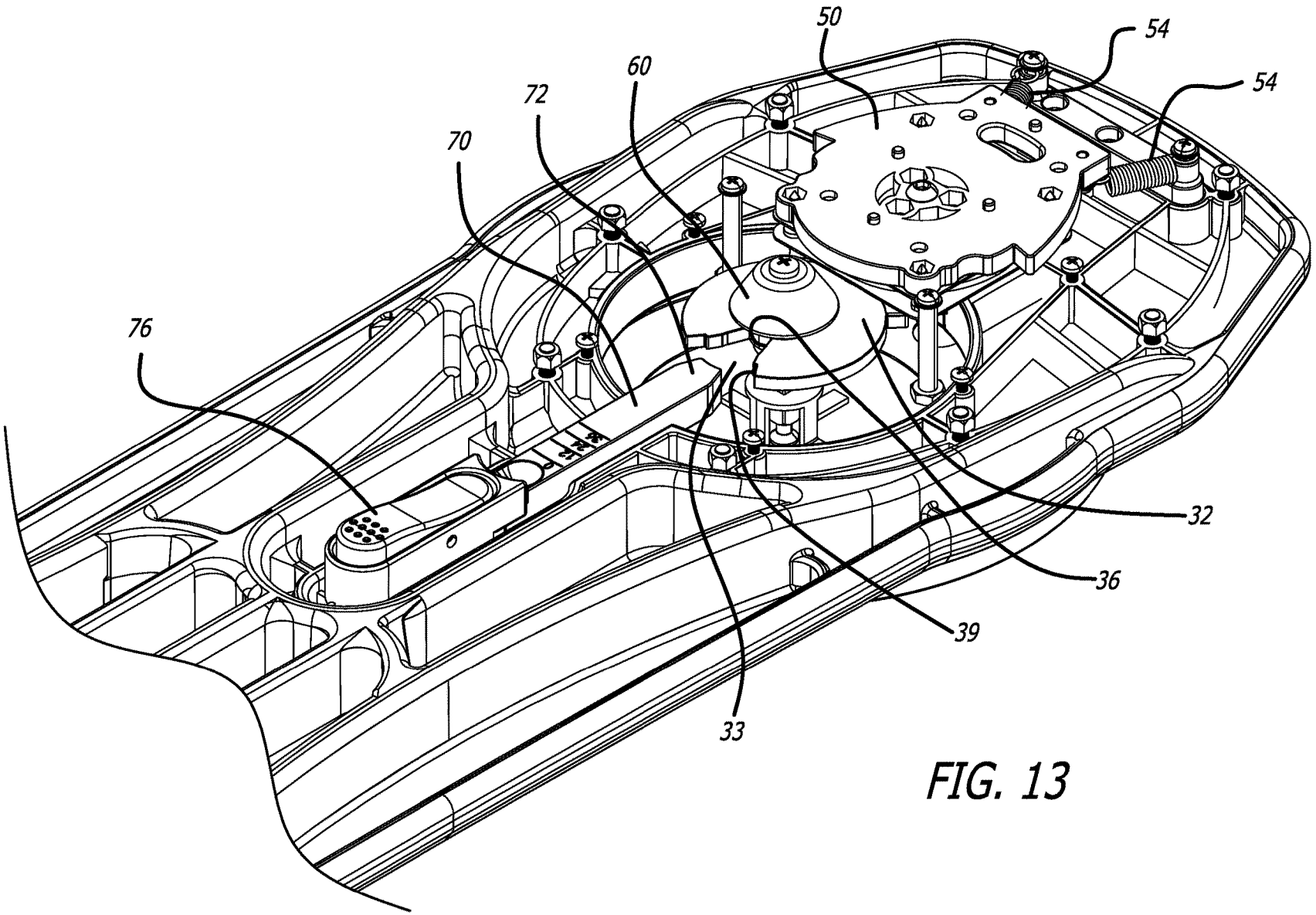
FIG. 13 is a bottom perspective view of the partially disassembled riding board of FIG. 11.

FIG. 13 is a bottom perspective view of the partially disassembled riding board of FIG. 11. Pawls 56 have been removed for clarity of illustration. The operation of slide lock 70, and the interaction of head 72 of slide lock 70 with opening 33 in first spur gear 32, can be seen in this figure. How far slide lock 70 is slid forward or back will determine how far first spur gear 32 and thus the overall steering mechanism can rotate. In this figure slide lock 70 is retracted as far as it will go, thus allowing the maximum freedom of movement of the steering mechanism which in this embodiment is 36°.

Figure 14:
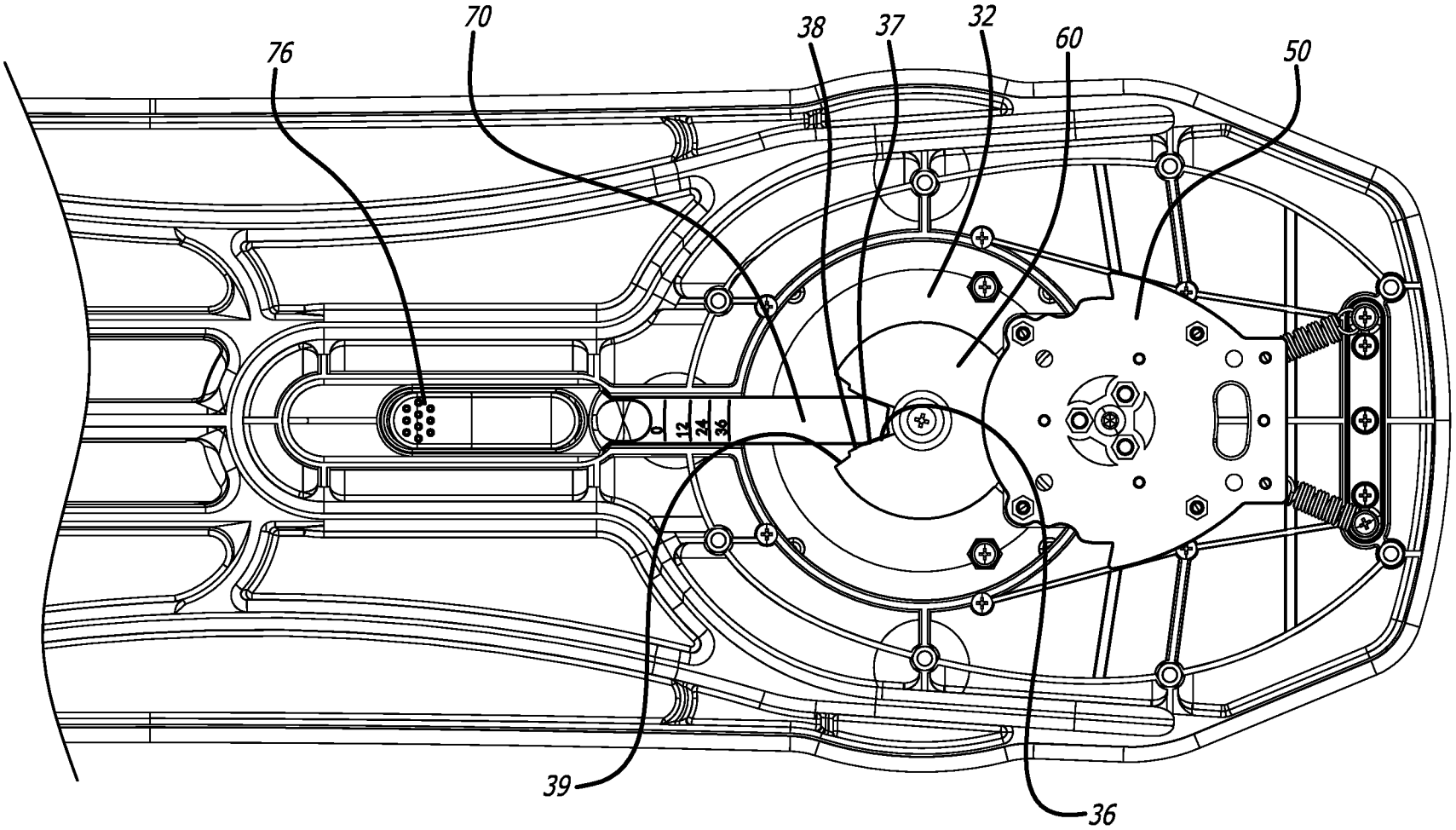
FIG. 14 is a bottom plan view of the partially disassembled riding board of FIG. 13, with the slide steering lock fully engaged thus preventing the rear truck from rotating, i.e., preventing any user steering of the rear truck via rotation of the steering platform.

FIG. 14 is a bottom plan view of the partially disassembled riding board 10 of FIG. 13, with the slide lock 70 fully engaged with first spur gear 32 thus preventing the rear truck 24 from rotating, i.e., preventing any user steering of the rear truck 24 via rotation of the steering platform 14. In the illustrative embodiment spur gear 32 has four separate stops: a $0^{th}$ stop corresponding to no rotational freedom; a first stop corresponding to ±12° of rotational freedom; a second stop corresponding to ±24° of rotational freedom; and a third stop corresponding to ±36° of rotational freedom.

Figure 15:
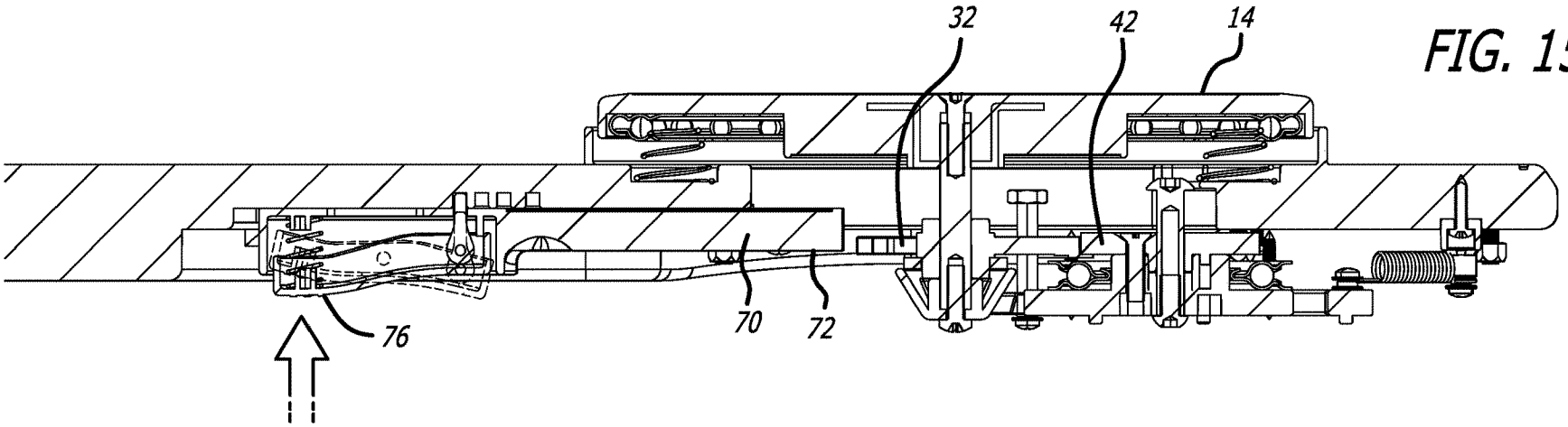
FIG. 15 is a side cutaway view of just the steering components of the riding board of FIG. 1, with the steering lock fully disengaged thus enabling the user to rotate the steering platform and thus steer the rear truck, and with an arrow to indicate the steering lock release lever being pressed.

FIG. 15 is a side cutaway view of just the steering components of the riding board 10 of FIG. 1, with the steering slide lock 70 maximally disengaged thus enabling the user to rotate the steering platform and thus steer the rear truck, and with an arrow to indicate the steering lock release lever 76 being pressed to enable sliding of slide lock 70.

Figure 16:
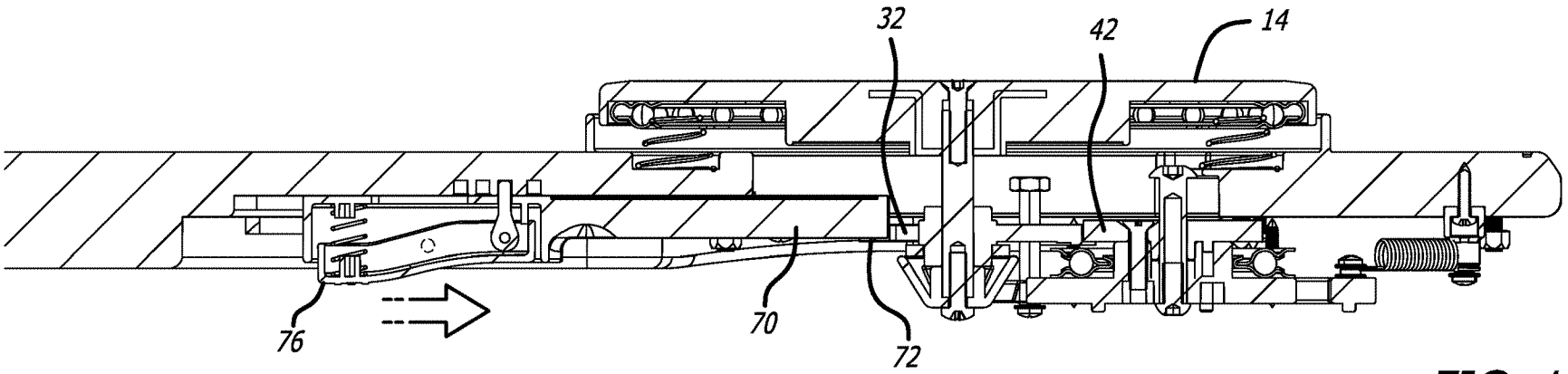
FIG. 16 is a side cutaway view according to FIG. 15, with an arrow to indicate the steering lock slide having been slid into the steering locked position.

FIG. 16 is a side cutaway view according to FIG. 15, with an arrow to indicate the steering lock slide 70 having been slid into its fully engaged position in which no user steering via the steering platform 14 can occur.

Figure 17:
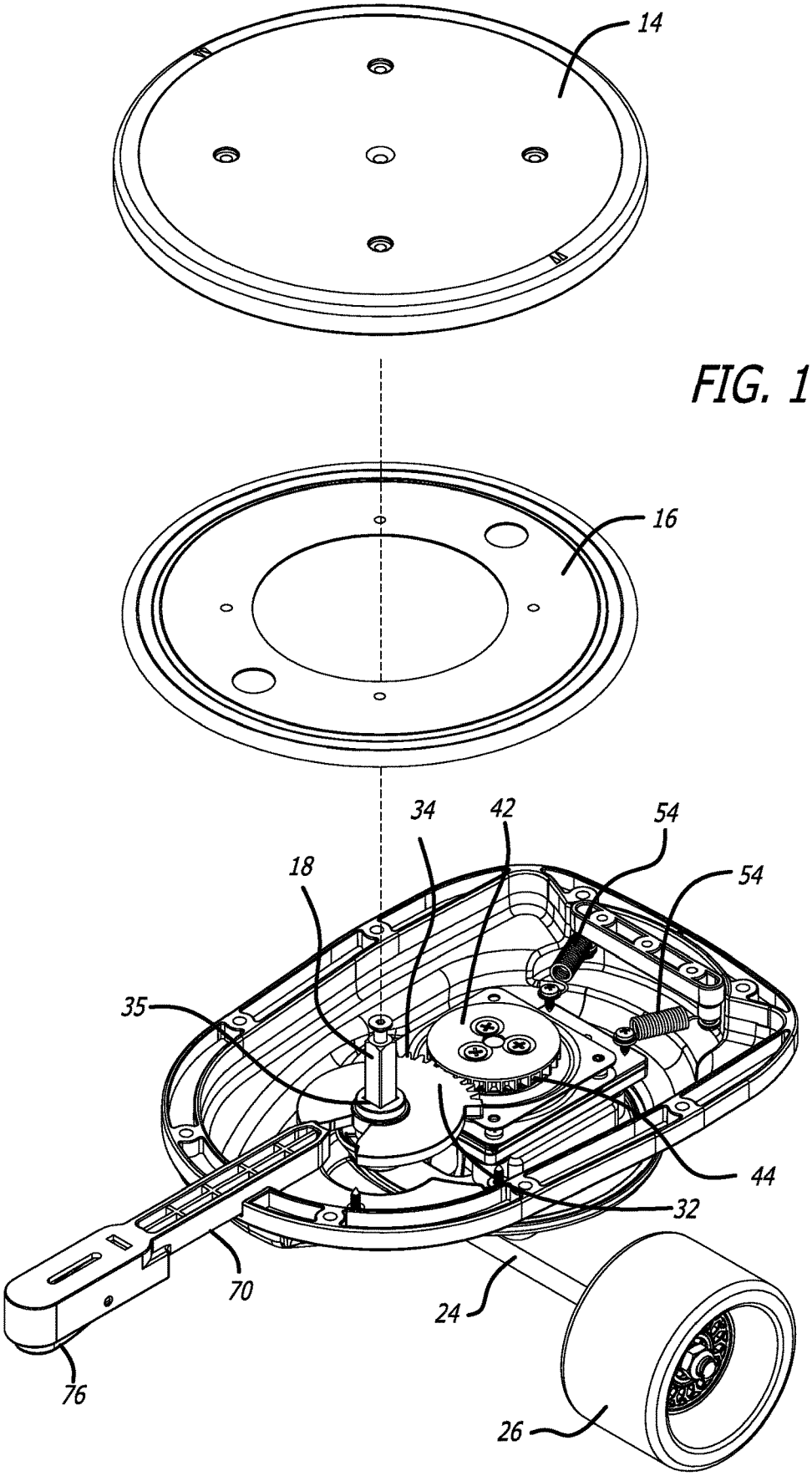
FIG. 17 is a partially exploded view of the steering mechanism and steering lock slide of the riding board of FIG. 1.

FIG. 17 is a simplified and partially exploded view of the steering mechanism and steering lock slide 70 of the riding board of FIG. 1, providing perhaps the clearest illustrating of the components and operation of the steering mechanism. Polygonal shaft 18 is affixed to the underside of steering platform 14, which rotates on bearing disc 16 similar to the operation of a "lazy Susan" rotating shelf mechanism. Polygonal shaft 18 extends through a matingly shaped hole 35 in first spur gear 32 such that polygonal shaft 18 can move up and down through first spur gear 32 and yet drive it rotationally when steering platform 14 is rotated by the user. First spur gear 32 has a number of teeth 34. Teeth 34 mesh with teeth 44 in second spur gear 42, with first spur gear 32 acting in series with second spur gear 42. Accordingly, when steering platform 14 and first spur gear 32 rotate in a CW direction, second spur gear 42 rotates in a CCW direction, and vice versa. Rear truck 24 is mounted to locking platform 50, which in turn is mounted to second spur gear 42. Thus, a CW rotation of the steering platform 14 produces a CCW rotation (steering) of the rear truck 24 and rear wheels 26, and vice versa.

First and second spur gears 32, 42 may have pitch diameters, such that a first amount of rotation of the rotatable steering platform 14 produces a second and different amount of rotation of the steerable pair of wheels. For example, a specified amount of rotation of the steering platform 14 could produce a larger amount of rotation of rear truck 24 for oversteering or more sensitive steering, or a specified amount of rotation of platform 14 could produce a smaller amount of rotation of rear truck 24 for understeering or less sensitive steering, according to how responsive consumers prefer the steering to be.

The skateboard of the invention can be either motorized as in the illustrative embodiment, or non-motorized. The motor could be an electric motor powered by a battery as in the illustrative embodiment, or alternatively could be gasoline- or other fuel-powered motor. If the motor is an electric motor, preferably the skateboard has an ON/OFF switch which turns the motor and any other electronics off.

In the illustrative embodiment the rear truck and rear axle and wheels can be directly reversed steered by the rider, and the front truck and front axle and wheels are mounted as on a standard skateboard and are not subject to direct steering by the user. Variations on the steering mechanisms are also possible. The skateboard could be provided with a reverse-steering mechanism as described herein on either the front and/or back trucks and axles. Alternatively, a skateboard could be constructed with one reverse-steering mechanism according to the present invention for one truck, and one direct-steering mechanism such as the steering mechanisms in the prior art discussed herein for the other truck.

In another embodiment, instead of the steering mechanism being locked and unlocked by pressure from the user's foot, the steering mechanism could be locked or unlocked via the remote control, or via some other manual control.

In the illustrative embodiment the riding board has front and rear skateboard trucks, each truck carrying two wheels. In an alternative embodiment, the board has only a single front wheel, and a steerable truck and two associated wheels in the rear. In another alternative embodiment, the board has only a single wheel in the rear which is steerable, and a conventional truck and two associated wheels in the front. In any of these embodiments, the rear wheel(s) can be steered via direct reverse steering as previously disclosed, including pressure-activated direct reverse steering.

A bracket could be provided on the skateboard for retaining the remote control when the skateboard is not in use.

It will be understood that the terms "generally," "approximately," "about," and "substantially," as used within the specification and the claims herein allow for a certain amount of variation from any exact dimensions, measurements, and arrangements, and that those terms should be understood within the context of the description and operation of the invention as disclosed herein.

All features disclosed in the specification, including the claims, abstract, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent, or similar purpose, unless expressly stated otherwise. Thus, unless expressly stated otherwise, each feature disclosed is one example only of a generic series of equivalent or similar features.

It will be appreciated that the term "present invention" as used herein should not be construed to mean that only a single invention having a single essential element or group of elements is presented. Similarly, it will also be appreciated that the term "present invention" encompasses a number of separate innovations which can each be considered separate inventions. Although the present invention has thus been described in detail with regard to the preferred embodiments and drawings thereof, it should be apparent to those skilled in the art that various adaptations and modifications of the present invention may be accomplished without departing from the spirit and the scope of the invention. Accordingly, it is to be understood that the detailed description and the accompanying drawings as set forth hereinabove are not intended to limit the breadth of the present invention, which should be inferred only from the following claims and their appropriately construed legal equivalents.

We claim:

1. A riding board for a rider to ride upon, the riding board comprising:

a riding platform for the rider to stand upon;

a front wheel axle including at least one front wheel;

a rear wheel axle including at least one rear wheel;

a rotatable steering platform adapted for the rider to step upon and to turn in a first rotational direction by pivoting a foot of the rider; and gearing which turns one of the front wheel axle and the rear wheel axle in a second rotational direction that is opposite to the first rotational direction in response to the rider pivoting said foot, the one of the front wheel axle and the rear wheel axle being turned by the gearing and defining a steerable axle.

2. The riding board of claim 1 further comprising:

a bias mechanism which biases the rotatable steering platform into an upward position;

a lock which automatically locks the rotatable steering platform in a first rotational position when the rotatable steering platform is in said first rotational position and in said upward position; and a release mechanism which unlocks the rotatable steering platform when the rider steps on the rotatable steering platform thereby moving the rotatable steering platform to a downward position, thereafter allowing the rider to turn the rotatable steering platform by pivoting the rider's rear foot.

3. The riding board of claim 2 wherein:

said bias mechanism defines a first bias mechanism;

said lock automatically locks the rotatable steering platform in a center position when the rotatable steering platform is in its upward position and its center position; and the riding board further comprises a second bias mechanism which biases the rotatable steering platform to a center position, such that when the rider steps off the rotatable steering platform and steers straight ahead, the first bias mechanism tends to move the rotatable steering platform to its upward position, the second bias mechanism tends to move the steering platform into its center position, and the lock automatically locks the rotatable steering platform in its center position.

4. The riding board of claim 2 wherein:

said bias mechanism defines a first bias mechanism;

said lock automatically locks the rotatable steering platform in a center position when the rotatable steering platform is in its upward position and its center position; and the riding board further comprises a second bias mechanism which biases the rotatable steering platform to its center position, such that when the rider picks the riding board up off of a ground surface, the first bias mechanism tends to move the rotatable steering platform to its upward position, the second bias mechanism tends to move the rotatable steering platform into its center position, and the lock automatically locks the rotatable steering platform its center position, thereby returning the riding board to conventional skateboard lean-to-steer operation.

5. The riding board of claim 2 wherein the release mechanism comprises:

a wedge which moves downward when the rider steps on the rotatable steering platform, the wedge moving downward causing a first component to move away from locking engagement with a second component, the second component being rotationally coupled to said steerable axle.

6. The riding board of claim 1 further comprising an adjustable steering limiter that limits a turn angle of said steerable axle.

7. The riding board of claim 1 wherein said steerable axle is said rear wheel axle.

8. The riding board of claim 7 wherein said front wheel axle is not steerable by the rider pivoting his front foot.

9. A riding board for a rider to ride upon, the riding board comprising:

a riding platform for the rider to stand upon;

a front wheel axle including at least one front wheel;

a rear wheel axle including at least one rear wheel;

a rotatable steering platform adapted for the rider to step upon and to turn by pivoting a foot of the rider, the rotatable steering platform being rotationally coupled to one of the front wheel axle and the rear wheel axle, said one of the front wheel axle and the rear wheel axle defining a steerable axle such that the rider can turn the steerable axle by pivoting said foot;

a first bias mechanism which biases the rotatable steering platform into an upward position;

a second bias mechanism which biases the rotatable steering platform to a straight-ahead steering position; and a lock which automatically locks the rotatable steering platform and the steerable axle in a straight-ahead steering position when the steering platform is in its upward position and the steering is in said straight-ahead steering position;

whereby when the rider steps off the riding board and picks the riding board up off of a ground surface, the first bias mechanism moves the rotatable steering platform to its upward position, the second bias mechanism moves the rotatable steering platform into its center position, and the lock automatically locks the rotatable steering platform to its straight-ahead steering position.

10. The riding board of claim 9 further comprising:

a release mechanism which unlocks the rotatable steering platform when a rider steps on the rotatable steering platform thereby moving the rotatable steering platform to a downward position, thereafter allowing the rider to turn the rotatable steering platform by pivoting the rider's foot.

11. A riding board for a rider to ride upon, the rider having a front foot and a rear foot, the riding board comprising:

a riding platform for the rider to stand upon;

a front truck disposed on an underside of the riding platform;

a pair of front wheels mounted to the front truck;

a rear truck disposed on an underside of the riding platform;

a pair of rear wheels mounted to the rear truck;

an electric motor;

a battery electrically coupled to the electric motor, the electric motor providing motive force to propel the riding board forward;

a rotatable platform suitable for the rider to place his rear foot upon and rotate by pivoting said rear foot; and a steering coupling mechanism that rotationally couples the rotatable platform to the rear truck such that when the rider pivots his rear foot in a clockwise direction, the rear truck turns in an opposite counterclockwise direction.

12. The riding board of claim 11 further comprising a steering locking mechanism such that said rotatable platform can be selectively rotatably locked and unlocked, whereby the rider can selectively use the riding board as either an electric skateboard having front and rear trucks and exhibiting conventional skateboard steering when the steering lock mechanism is engaged, or as an electric steerable drift board exhibiting drift-type steering when the steering locking mechanism is disengaged.

13. The riding board of claim 12 wherein the steering locking mechanism can be selectively engaged and disengaged by the rider while riding on the riding board.

14. The riding board of claim 11 wherein the steering coupling mechanism comprises:

a first spur gear coupled to the rotatable platform disposed beneath the rider platform; and a second spur gear coupled to the rear truck and disposed beneath the rider platform, the first spur gear meshed with the second spur gear.

15. The riding board of claim 14 wherein the first spur gear is coupled to the rotatable platform by a shaft having a polygonal cross-section, the shaft being rotationally coupled to the rotatable platform and extending downward therefrom and into a central hole in the first spur gear, the central hole having a polygonal shape which mates with the shaft such that the shaft rotating causes the first spur gear to rotate.

16. A riding board for a rider to ride upon, the rider having a front foot and a rear foot, the riding board comprising:

a riding platform for a rider to place at least his front foot upon;

at least one front wheel disposed on an underside of the riding platform;

a pair of rear wheels disposed on an underside of the riding platform;

a rotatable platform suitable for the rider to place his rear foot upon and rotate by pivoting said rear foot;

a steering coupling mechanism that rotationally couples the rotatable platform to the pair of rear wheels, the pair of rear wheels defining a steerable pair of rear wheels; and a steering lock operable by the rider while riding the riding board, wherein the steering lock selectively locks and unlocks the steerable pair of rear wheels from being steered by said rotatable platform.

17. The riding board of claim 16 wherein said steering lock is pressure-deactivated, the rider unlocking the steering lock by stepping upon the rotatable platform thereby allowing the rotatable platform to rotate.

18. The riding board of claim 16 wherein:

the steering coupling mechanism comprises first and second spur gears disposed beneath the riding platform;

the first spur gear is rotationally coupled to the rotatable platform;

the second spur gear is rotationally coupled to the rear wheels;

the first spur gear meshes with the second spur gear such that a clockwise rotation of the first spur gear produces a counterclockwise rotation of the second spur gear, whereby when the rider's rear foot is on the rotatable platform and the rider pivots his rear foot in the clockwise direction, the rear wheels steer in a counterclockwise direction.

19. The riding board of claim 18 wherein the first and second spur gears have different pitch diameters, such that a first amount of rotation of the rotatable platform produces a second and different amount of rotation of the steerable pair of rear wheels.

20. The riding board of claim 16 further comprising:

a battery; and an electric motor selectively coupled to at least one of said wheels for selectively propelling the riding board; and wherein the riding platform is sufficient large for an adult rider to either:

a) place both his front foot and his rear foot on the riding platform without stepping on the rotatable platform and to ride the riding board as a skateboard, or b) place his front foot on the riding platform and his rear foot on the rotatable platform in order to directly steer the pair of rear wheels by rotating his rear foot.

* * * * *